US010657738B2

(12) United States Patent
Bauchot et al.

(10) Patent No.: US 10,657,738 B2
(45) Date of Patent: May 19, 2020

(54) RECONSTRUCTING AN ACCIDENT FOR A VEHICLE INVOLVED IN THE ACCIDENT

(75) Inventors: Frederíc Bauchot, Saint-Jeannet (FR); Jean-Yves Clement, Saint Jeannet (FR); Gerard Marmigère, Drap (FR); Carole Truntschka, Saint-Laurent-du-Var (FR)

(73) Assignee: International Business Machines Corporation, Armonk, NY (US)

( * ) Notice: Subject to any disclaimer, the term of this patent is extended or adjusted under 35 U.S.C. 154(b) by 2051 days.

(21) Appl. No.: 12/266,598

(22) Filed: Nov. 7, 2008

(65) Prior Publication Data

US 2010/0106417 A1 Apr. 29, 2010

(30) Foreign Application Priority Data

Oct. 27, 2008 (EP) ..... 08305732

(51) Int. Cl.
*G07C 5/08* (2006.01)
*G07C 5/00* (2006.01)

(52) U.S. Cl.
CPC ..... *G07C 5/085* (2013.01); *G07C 5/008* (2013.01); *F25J 2290/10* (2013.01)

(58) Field of Classification Search
USPC ..... 701/213
See application file for complete search history.

(56) References Cited

U.S. PATENT DOCUMENTS 5,296,852 A * 3/1994 Rathi ..... G08G 1/04 340/933
5,446,659 A * 8/1995 Yamawaki ..... 701/32.2
5,628,033 A * 5/1997 Dilich ..... G01C 11/02 348/136
6,141,611 A 10/2000 Mackey et al.
6,246,933 B1 6/2001 Bague
(Continued)

FOREIGN PATENT DOCUMENTS

CN 11061060A A 10/2007
EP 1320004 B1 5/2004
(Continued)

OTHER PUBLICATIONS

U.S. Appl. No. 12/176,767, filed Jul. 21, 2008; Conf. No. 3224; Customer No. 30449.
(Continued)

*Primary Examiner* — Rachel L. Porter
(74) *Attorney, Agent, or Firm* — Schmeiser, Olsen & Watts, LLP; Mark Vallone

(57) ABSTRACT

A method for identifying a trajectory for each vehicle involved in an accident. The method begins by plotting on a Cartesian Coordinate Plane GNSS locations corresponding to a vehicle involved in the accident. Next, the method identifies GNSS locations on the Cartesian Coordinate Plane where the vehicle was speeding. Next, the method marks those GNSS locations on the Cartesian Coordinate Plane where the vehicle involved in the accident was skidding. The process of plotting and identifying speeding as well as skidding is repeated for all vehicles involved in the accident. The Cartesian Coordinate plane then having all vehicle trajectories residing therein is sent to an output device.

6 Claims, 5 Drawing Sheets

(56) References Cited

U.S. PATENT DOCUMENTS

| | | | | |
|---|---|---|---|---|
| 6,675,074 | B2 * | 1/2004 | Hathout | B60K 28/165 342/357.31 |
| 7,254,482 | B2 | 8/2007 | Kawasaki et al. | |
| 7,317,397 | B2 | 1/2008 | Gunsauley | |
| 7,327,238 | B2 | 2/2008 | Bhogal et al. | |
| 2002/0059086 | A1 * | 5/2002 | Wahlbin et al. | 705/4 |
| 2003/0028298 | A1 | 2/2003 | Macky et al. | |
| 2003/0046003 | A1 * | 3/2003 | Smith et al. | 701/213 |
| 2004/0102984 | A1 * | 5/2004 | Wahlbin | G06Q 40/08 705/4 |
| 2005/0137757 | A1 * | 6/2005 | Phelan et al. | 701/1 |

FOREIGN PATENT DOCUMENTS

| | | |
|---|---|---|
| JP | 2004090879 | 3/2004 |
| JP | 2005100107 | 4/2005 |
| JP | 2006168717 | 6/2006 |
| WO | 2006053676 A1 | 5/2006 |
| WO | 2007078942 A2 | 7/2007 |
| WO | 2008007878 A1 | 1/2008 |

OTHER PUBLICATIONS

"Bezier Curve", 9 pages, retrieved on Sep. 4, 2013 from the Internet: <URL: http://en.wikipedia.org/wiki/B%c3%a9zier_curve>.

Calzaretta et al., Vehicle Accident Reconstruction Technology: Finding New Roads to Trial Presentations, retrieved on Aug. 9, 2017 from the Internet: <URL: http://www.claimsjournal.com/news/national/2016/02/29/269116.htm>, 1 page.

Andrei Iancu, "Remarks by Director Iancu at the Intellectual Property Owners Association 46th Annual Meeting", Sep. 24, 2018, Chicago, Illinois, retrieved on Nov. 18, 2018 from the Internet, 7 pages.

* cited by examiner

RECONSTRUCTING AN ACCIDENT FOR A VEHICLE INVOLVED IN THE ACCIDENT

BACKGROUND OF THE INVENTION

The present invention relates generally to accident reconstruction, and more particularly to identifying a trajectory for each vehicle involved in an accident.

It is common for an automobile accident to occur in which the only witness is the offending party. When the offending party fails to provide contact information, the innocent victim is left without a means of identifying the responsible party or determining who was at fault.

Similarly, when two parties are involved in an automobile accident, the shock of the situation may impair one party's ability to remember and/or articulate the events immediately preceding the accident or subsequent thereto.

SUMMARY OF THE INVENTION

The present invention provides a method for identifying a trajectory for each vehicle involved in an accident, said method comprising:

plotting at least one Global Navigation Satellite System (GNSS) location on a Cartesian Coordinate Plane, each GNSS location of said at least one GNSS location corresponding to a unique vehicle having been involved in said accident;

identifying a GNSS location of said at least one GNSS location on said Cartesian Coordinate Plane if it was determined that said vehicle was speeding at said identified GNSS location;

marking a GNSS location of said at least one GNSS location on said Cartesian Coordinate Plane if it was determined that said vehicle was skidding at said marked GNSS location;

repeating said plotting and said identifying and said marking for at least one other vehicle having been involved in said accident; and sending said Cartesian Coordinate Plane to an output device.

DETAILED DESCRIPTION OF THE DRAWINGS

Definitions

The term 'Global Navigation Satellite System (GNSS)' as used herein is defined as a satellite navigation system providing autonomous geo-spatial positioning with global coverage. Examples of GNSS include, inter alia, Global Positioning System (GPS), Galileo, GLObal'naya NAvigatsionnaya Sputnikovaya Sistema (GLONASS), Indian Regional Navigational Satellite System (IRNSS), Doppler Orbitography and Radio-positioning Integrated by Satellite (DORIS), Quasi-Zenith Satellite System (QZSS), and Beidou Navigation System.

Specification

Although certain embodiments of the present invention are described herein, it is understood modifications may be made to the present invention without departing from its course and scope. Scope of the present invention is not limited to the number of constituting components, the materials thereof, the shapes thereof, the relative arrangement thereof, etc. Furthermore, while the accompanying drawings illustrate certain embodiments of the present invention, such drawings are not necessarily depicted to scale.

Figure 1:
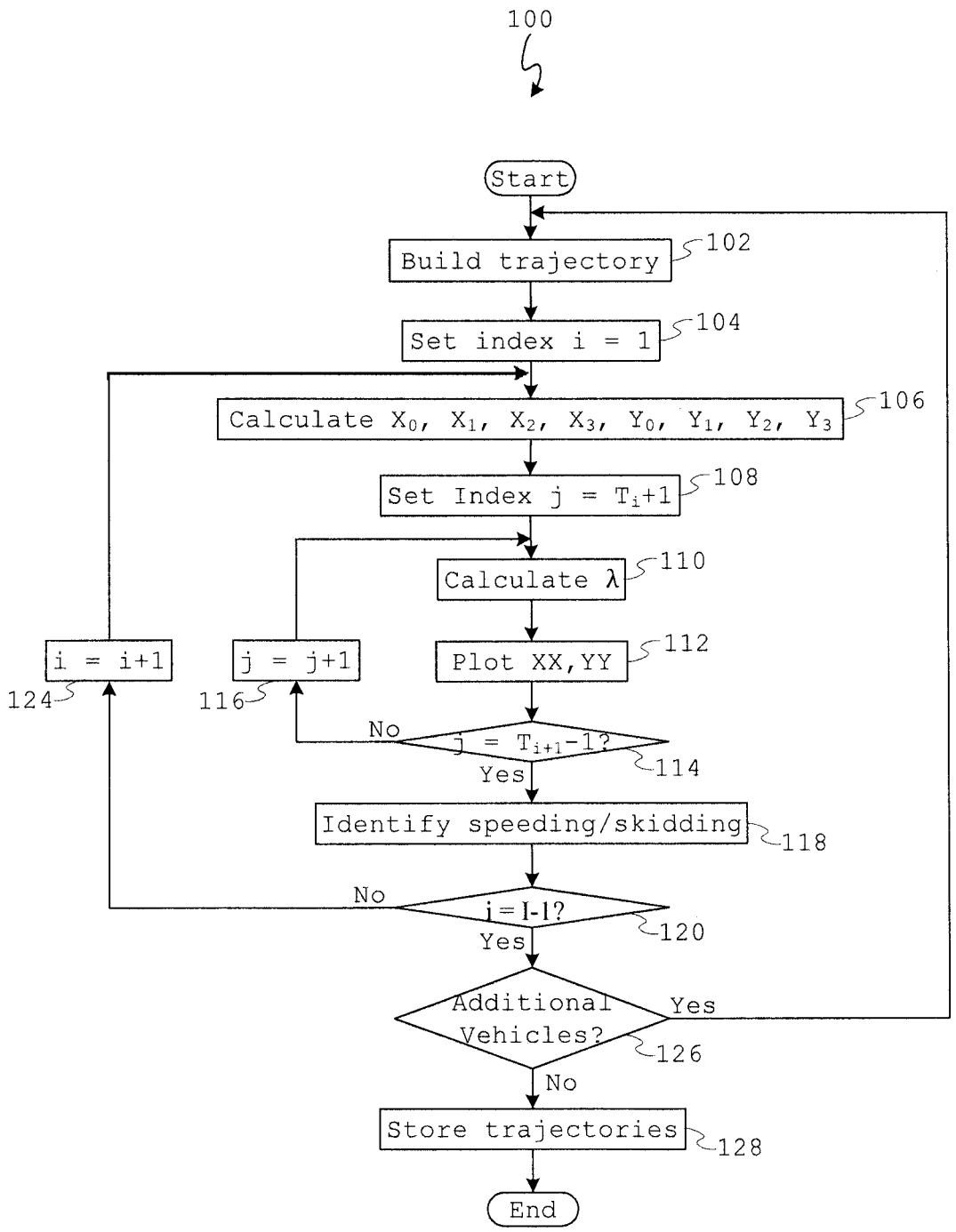
FIG. 1 illustrates a method for identifying a trajectory for each vehicle involved in an accident, in accordance with embodiments of the present invention.

FIG. 1 illustrates a method 100 for identifying a trajectory for each vehicle involved in an accident, in accordance with embodiments of the present invention.

The present invention utilizes an accident report created by at least one vehicle involved in an accident. Vehicles involved in the accident not only include those vehicles which physically participated in the accident, but also include vehicles within a predetermined distance which may be witnesses to the accident/incident.

The accident report comprises information taken from each vehicle involved in the accident. The accident report comprises for each vehicle involved in the accident: a list of indices indeed (i), a list of timestamps ($T_i$), a list of Global Navigation Satellite System (GNSS) locations ($x_i$, $y_i$), as well as a list of the specific vehicle's orientation ($Dx_i$, $Dy_i$). Each orientation pair ($Dx_i$, $Dy_i$) not only identify the direction in which the vehicle is pointing, but also represent a measurement of the vehicle's speed along the x-axis and along the y-axis. Each timestamp corresponds to both a unique GNSS location and a unique orientation. An example of data residing in an accident report for a single vehicle may be as follows:

| Index (i) | Time ($T_i$) | $x_i$ | $y_i$ | $Dx_i$ | $Dy_i$ |
|---|---|---|---|---|---|
| 1 | 0 | 2 | 8 | 0.5 | −2.5 |
| 2 | 10 | 3 | 4 | 0.5 | −1.5 |
| 3 | 20 | 4 | 3 | 1 | 1 |
| 4 | 30 | 6 | 6 | 0.75 | 1.5 |
| 5 | 40 | 7 | 8 | 1 | 1 |
| 6 | 50 | 8 | 8 | 0 | −1 |
| 7 | 60 | 7 | 4 | 0 | −2 |
| 8 | 70 | 8 | 3 | 1 | −1 |
| 9 | 80 | 8 | 2 | −1 | −1 |
| 10 | 90 | 6 | 2 | −2 | 0 |
| 11 | 100 | 1 | 2 | −4 | 0 |

Method 100 begins with step 102, which comprises building a trajectory for a vehicle involved in the accident.

Step 102 comprises building a trajectory for a vehicle involved in the accident. Utilizing the accident report, step 102 overlays onto a Cartesian Coordinate Plane all GNSS locations ($x_i$, $y_i$) for a vehicle involved in an accident. The GNSS locations correspond to a path a vehicle took prior to, during, and subsequent to an accident. The GNSS locations are overlaid on the Cartesian Coordinate Plane so a path may be drawn through the GNSS locations in the order of the timestamps ($T_i$). After completion of step 102, the method 100 continues with step 104 which comprises setting index i=1.

Step 104 comprises setting index i=1. By setting index i=1, step 104 prepares the method 100 for calculating all intermediate GNSS locations between timestamps $T_i$ for i=1, 2, . . . , I. I represents the total number of timestamps corresponding to a specific vehicle which reside in the accident report. After completion of step 104, the method 100 continues with step 106 which comprises calculating $X_0$, $X_1$, $X_2$, $X_3$, $Y_0$, $Y_1$, $Y_2$, and $Y_3$.

Step 106 comprises calculating $X_0$, $X_1$, $X_2$, $X_3$, $Y_0$, $Y_1$, $Y_2$, and $Y_3$. The values $X_0$, $X_1$, $X_2$, $X_3$, $Y_0$, $Y_1$, $Y_2$, and $Y_3$ are coordinate characteristics of a cubic Bezier curve used to approximate the intermediate GNSS locations between timestamps for the vehicle involved in the accident. The coordinate characteristics of the cubic Bezier curve are calculated as follows:

$$X_0 = x_i$$

$$X_1 = x_i + \frac{Dx_i}{3}$$

$$X_2 = x_{i+1} + \frac{Dx_{i+1}}{3}$$

$$X_3 = x_{i+1}$$

$$Y_0 = y_i$$

$$Y_1 = y_i + \frac{Dy_i}{3}$$

$$Y_2 = y_{i+1} + \frac{Dy_{i+1}}{3}$$

$$Y_3 = y_{i+1}$$

After calculating $X_0$, $X_1$, $X_2$, $X_3$, $Y_0$, $Y_1$, $Y_2$, and $Y_3$, step 106 is complete and the method 100 continues with step 108 which comprises setting index $j=T_i+1$.

Step 108 comprises setting indeed $j=T_i+1$. By setting index $j=T_i+1$, step 108 prepares the method 100 for calculating all intermediate GNSS locations between timestamps $T_i$ and $T_{i+1}$. Note that j does not begin at $T_i$, mainly because the GNSS location of the vehicle at time $T_i$ was already overlaid on the Cartesian Coordinate Plane pursuant to step 102, supra. After completion of step 108, the method 100 continues with step 110 which calculates Lambda (λ).

Step 110 calculates Lambda (λ) as a relative time offset for the interval between GNSS locations. Before calculating Lambda (λ), step 110 first determines index z so that z satisfies the condition where $T_z \leq j < T_{z+1}$. For example, if i=3, $T_i$=20, and j=24, then index z must satisfy the condition $T_z \leq j < T_{z+1}$. Since j=24, the condition index z must satisfy is $T_z \leq 24 < T_{z+1}$. Since $T_3$=20 and 20<24, $T_3$ can equal $T_z$. Thus 20≤24<30 and index z satisfies the condition where z=3.

Step 110 utilizes index z to calculate Lambda (λ) according to $$\lambda = \frac{j - T_z}{T_{z+1} - T_z}.$$

Thus, if i=3, $T_i$=20, j=24, and z=3, then $$\lambda = \frac{j - T_z}{T_{z+1} - T_z} = \frac{24 - T_3}{T_{3+1} - T_3} = \frac{24 - 20}{30 - 20} = \frac{4}{10} = 0.4.$$

After calculating Lambda (λ), step 110 ends and the method 100 continues with step 112 which comprises plotting XX and YY on the Cartesian Coordinate Plane.

Step 112 comprises plotting XX and YY on the Cartesian Coordinate Plane. Before plotting XX and YY on the Cartesian Coordinate Plane, step 112 must first calculate both XX and YY. Coordinate XX,YY is calculated according to the following functions:

$$XX = X_0*(1-\lambda)^3 + 3 + X_1*\lambda*(1-\lambda)^2 + 3*X_2*\lambda^2*(1-\lambda) + X_3*\lambda^3$$

$$YY = Y_0*(1-\lambda)^3 + 3 + Y_1*\lambda*(1-\lambda)^2 + 3*Y_2*\lambda^2*(1-\lambda) + Y_3*\lambda^3$$

After calculating XX and YY, step 112 plots XX,YY on the Cartesian Coordinate Plane. After completion of step 112, the method 100 continues with step 114 which comprises determining if $j=T_{i+1}-1$.

Step 114 which comprises determining if $j=T_{i+1}-1$. The goal of steps 108 through 114 is to approximate the intermediate GNSS locations between timestamps for the vehicle involved in the accident. It is assumed that the i timestamps are spaced uniformly apart in time. For example, using the accident report data provide supra, the timestamps are spaced apart every ten (10) seconds.

Plotting XX,YY utilizing index j is performed every one second from $T_i$ to $T_{i+1}-1$. Thus using the provided accident report data, steps 108 through 114 would approximate the GNSS location of the vehicle involved in the accident every one second between $T_i+1$ and $T_{i+1}-1$. If j does equal $T_{i+1}-1$, method 100 continues with step 118 which comprises identifying instances of speeding and/or skidding.

However, if j does not equal $T_{i+1}-1$, then the method 100 continues by increases index j by one (i.e. j=j+1) in step 116 and looping back to step 110 to perform steps 110 through 114 for the updated j.

Step 118 comprises identifying instances of speeding and/or skidding. Step 118 identifies whether the vehicle was speeding by calculating the average speed of the vehicle between timestamps $T_i$ and $T_{i+1}$. Since the timestamps are uniformly spaced apart and coupled with the fact that the GNSS locations identify location, the calculation of $$\text{Average Speed} = \frac{\text{Distance Traveled}}{\text{Time of Travel}}$$

is relatively simple for step 118 to perform. If the average speed of the vehicle exceeds a speed threshold, step 118 marks the approximate GNSS locations between $T_i$ and $T_{i+1}$ on the Cartesian Coordinate Plane in such a way that it is understood to an end user that the vehicle was speeding. For an example of the identifying marks, see 414 in FIG. 4, infra.

In one embodiment of the present invention, the speed threshold is equal to the speed limit on the road the vehicles was traveling and is provided in the accident report. In an alternative embodiment of the present invention, the speed threshold value is provided by an end user.

Step 118 also identifies whether the vehicle was skidding between timestamps $T_i$ and $T_{i+1}$. Skidding refers to an unexpected or uncontrollable sliding on a surface by something not rotating (i.e. the vehicle tires). Step 118 identifies instances of skidding by reviewing the intermediate GNSS locations between timestamps $T_i$ and $T_{i+1}$ and comparing that information with the vehicle's orientation ($Dx_i$, $Dy_i$) at time $T_i$. If the vehicle orientation when compared to the path produced by the intermediate GNSS locations exceeds a skid threshold, step 118 marks the Cartesian Coordinate Plane in such a way that it is understood to an end user that the vehicle was skidding. For an example of the identifying marks, see 402 in FIG. 4, infra. In one embodiment of the present invention the skid threshold is provided by an end user. After completion of step 118, the method 100 continues with step 120 which comprises determining whether i=I.

Step 120 comprises determining whether i=I−1. Value I represents the total number of timestamps ($T_i$) corresponding to a single vehicle that was involved in the accident. If i=I−1, method 100 completed approximating the intermediate GNSS locations between timestamps for the vehicle involved in the accident; and the method 100 continues with step 124 which comprises determining whether vehicle information pertaining to another vehicle resides in the accident report.

However, if i does not equal I, then the method 100 continues by increases index i by one (i.e. i=i+1) in step 122 and looping back to step 106 to perform steps 104 through 120 for the updated i.

Step 124 comprises determining whether vehicle information pertaining to another vehicle resides in the accident report. The method 100 overlays the trajectories for all vehicles involved in the accident onto the Cartesian Coordinate Plane. Therefore, step 124 determines whether the method 100 has overlaid all vehicle information residing in the accident report to the Cartesian Coordinate Plane. If all vehicles have been processed pursuant to steps 102 through 124, then step 124 returns a value that no additional vehicle information resides in the accident report; and the method 100 continues with step 126 which comprises storing the trajectories to an output device 910 (see FIG. 5, infra).

However, if all vehicles have not been processed pursuant to steps 102 through 124, then step 124 returns a value that yes additional vehicle information resides in the accident report; and the method loops back to step 102 to perform steps 102 through 124 for a different vehicle.

Figure 5:
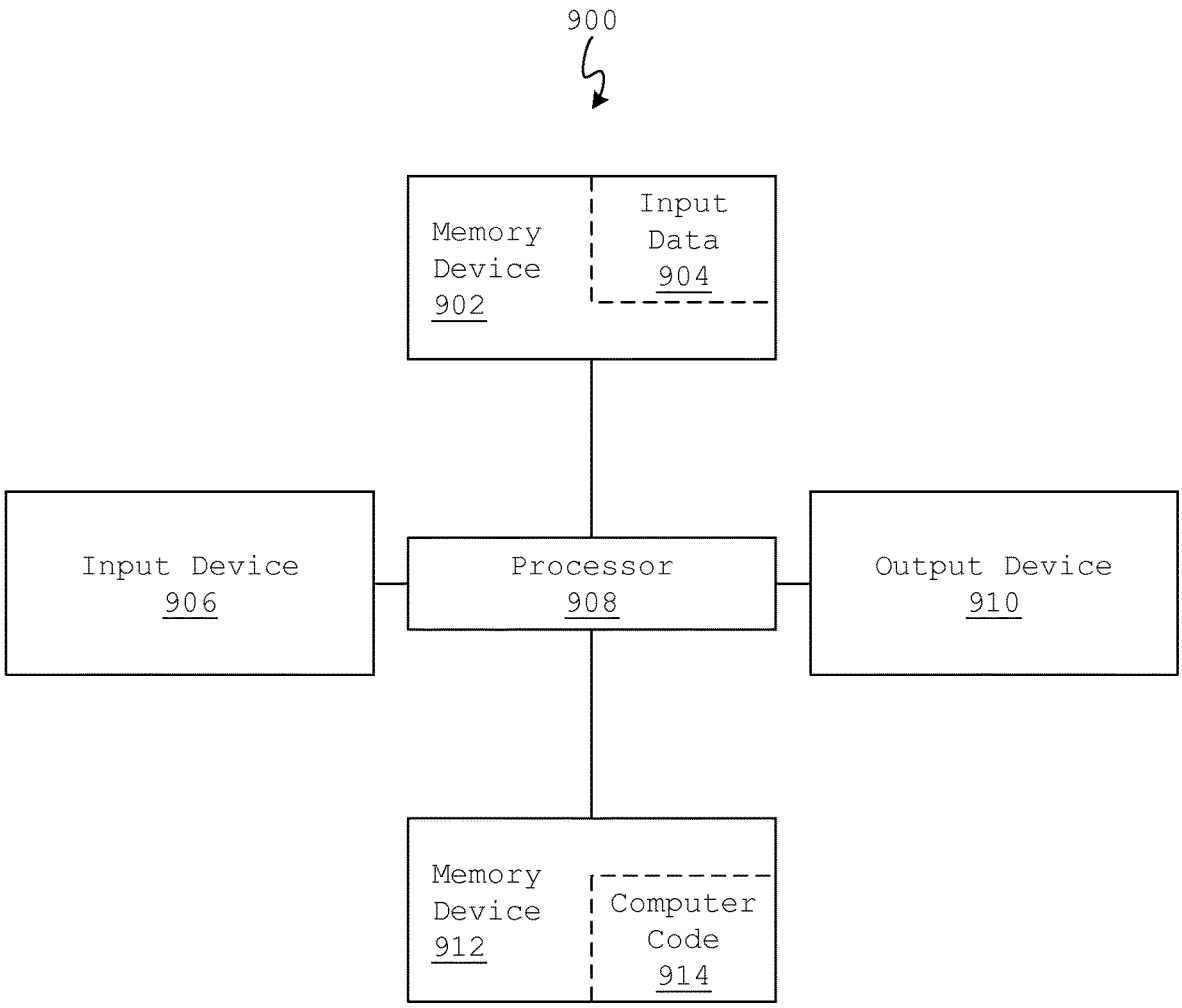
FIG. 5 illustrates a computer system which may facilitate a method for identifying a trajectory for each vehicle involved in an accident, in accordance with embodiments of the present invention.

Step 126 comprises storing the trajectories to an output device 910 (see FIG. 5, infra). After completion of step 126, the method 100 ends.

Figure 2:
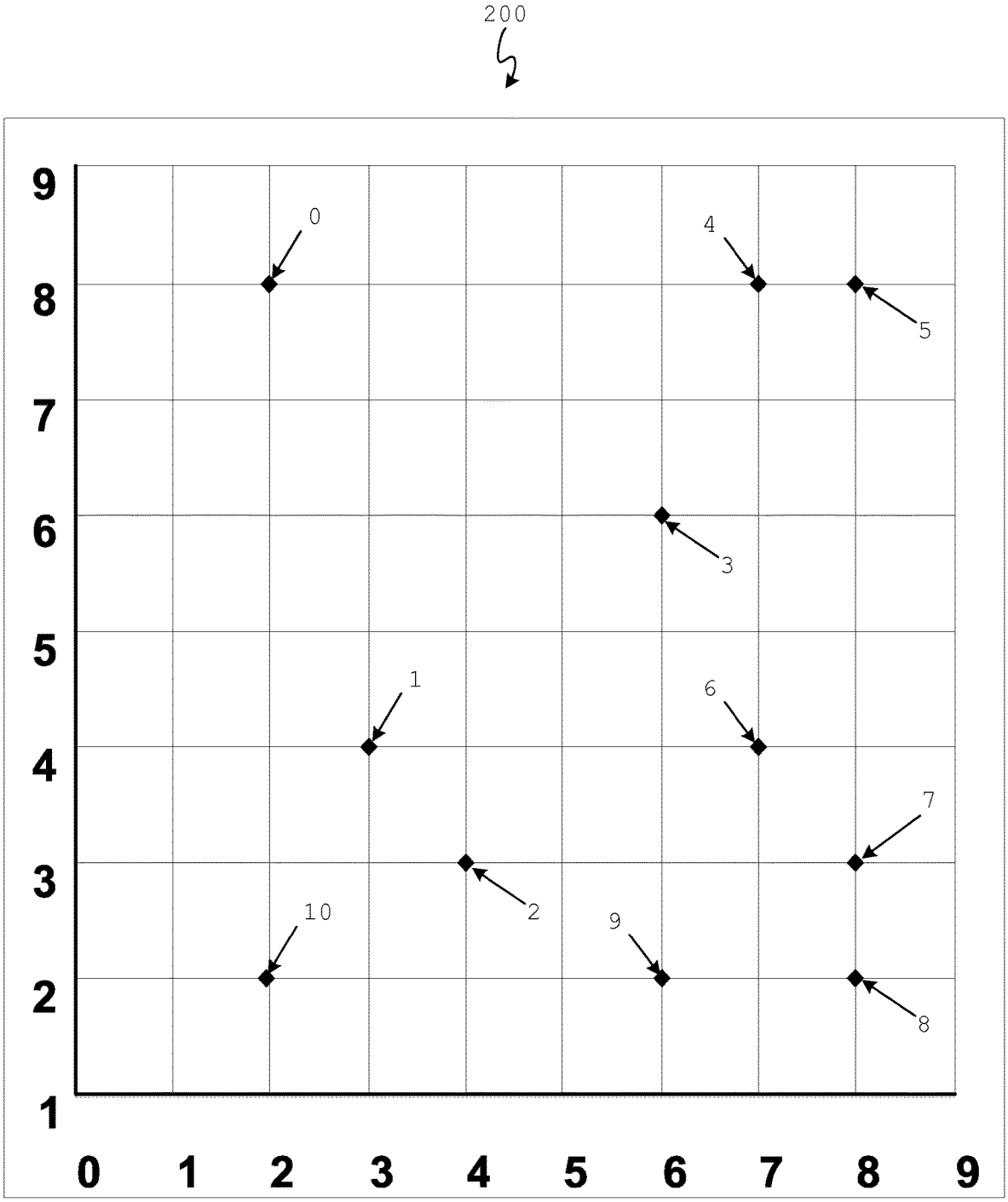
FIG. 2 illustrates an accident reconstruction comprising an initial trajectory of a vehicle involved in an accident, in accordance with embodiments of the present invention.

FIG. 2 illustrates a Cartesian Coordinate Plane 200 comprising an initial trajectory of a vehicle involved in an accident, in accordance with embodiments of the present invention.

The Cartesian Coordinate Plane 200 comprises GNSS locations 0 through 10 for one of the vehicles involved in the accident. The Cartesian Coordinate Plane 200 illustrated herein was produced pursuant to step 102, see FIG. 1, supra.

Figure 3:
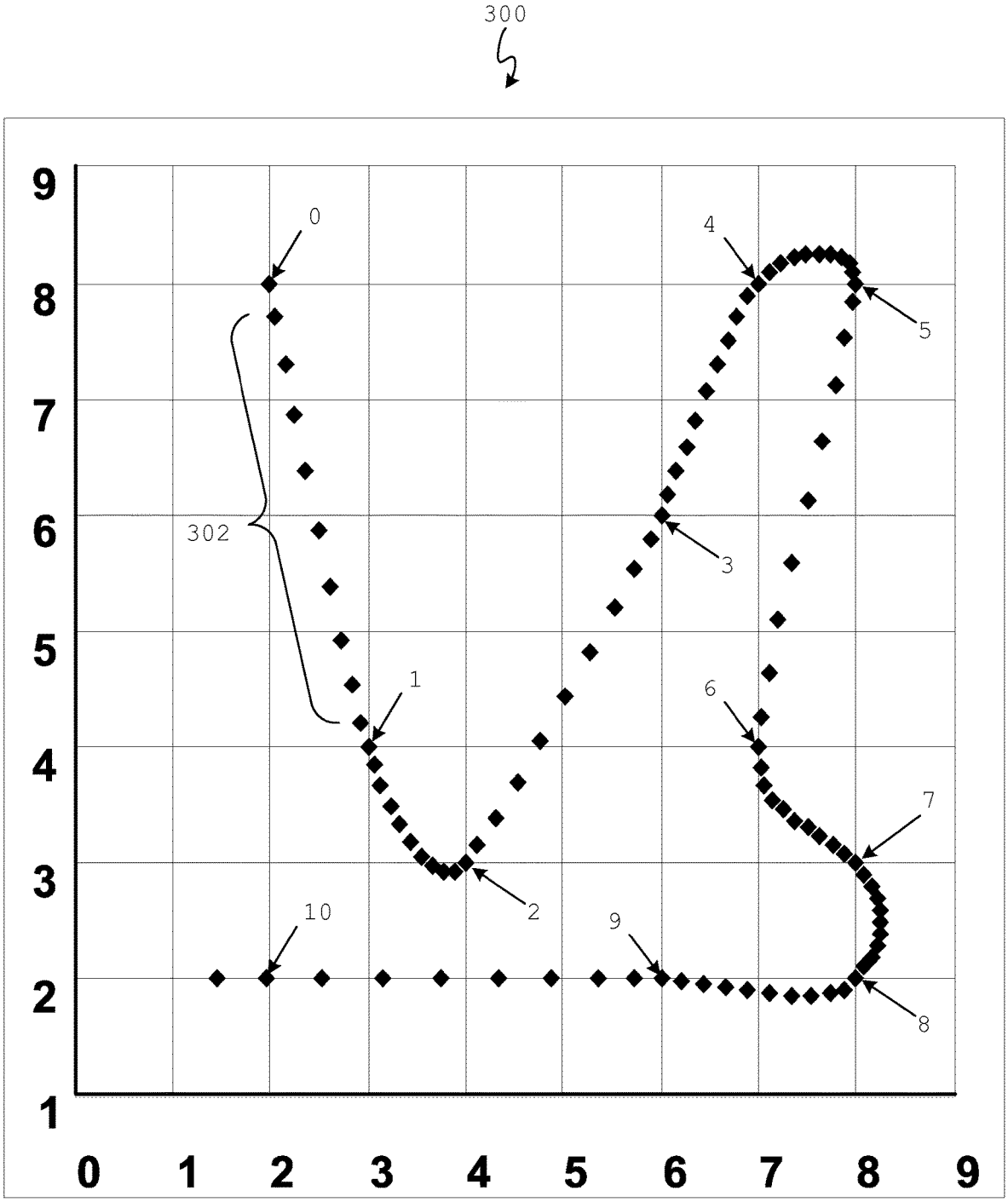
FIG. 3 illustrates an accident reconstruction comprising a trajectory of a vehicle involved in an accident utilizing Bezier curves to approximate the complete path of the vehicle, in accordance with embodiments of the present invention.

FIG. 3 illustrates a Cartesian Coordinate Plane 300 comprising a trajectory of a vehicle involved in an accident utilizing Bezier curves to approximate the complete path of the vehicle, in accordance with embodiments of the present invention.

The Cartesian Coordinate Plane 300 comprises GNSS locations 0 through 10 for one of the vehicles involved in the accident. FIG. 3 further includes the intermediate GNSS locations 302 between timestamps for the vehicle involved in the accident. Specifically, the intermediate GNSS locations 302 (as well as all intermediate locations between successive timestamps) were calculated between two timestamps pursuant to step 104 through 114, see FIG. 1, supra. The entire Cartesian Coordinate Plane 300 illustrated herein was produced pursuant to steps 102 through 114, see FIG. 1, supra.

Figure 4:
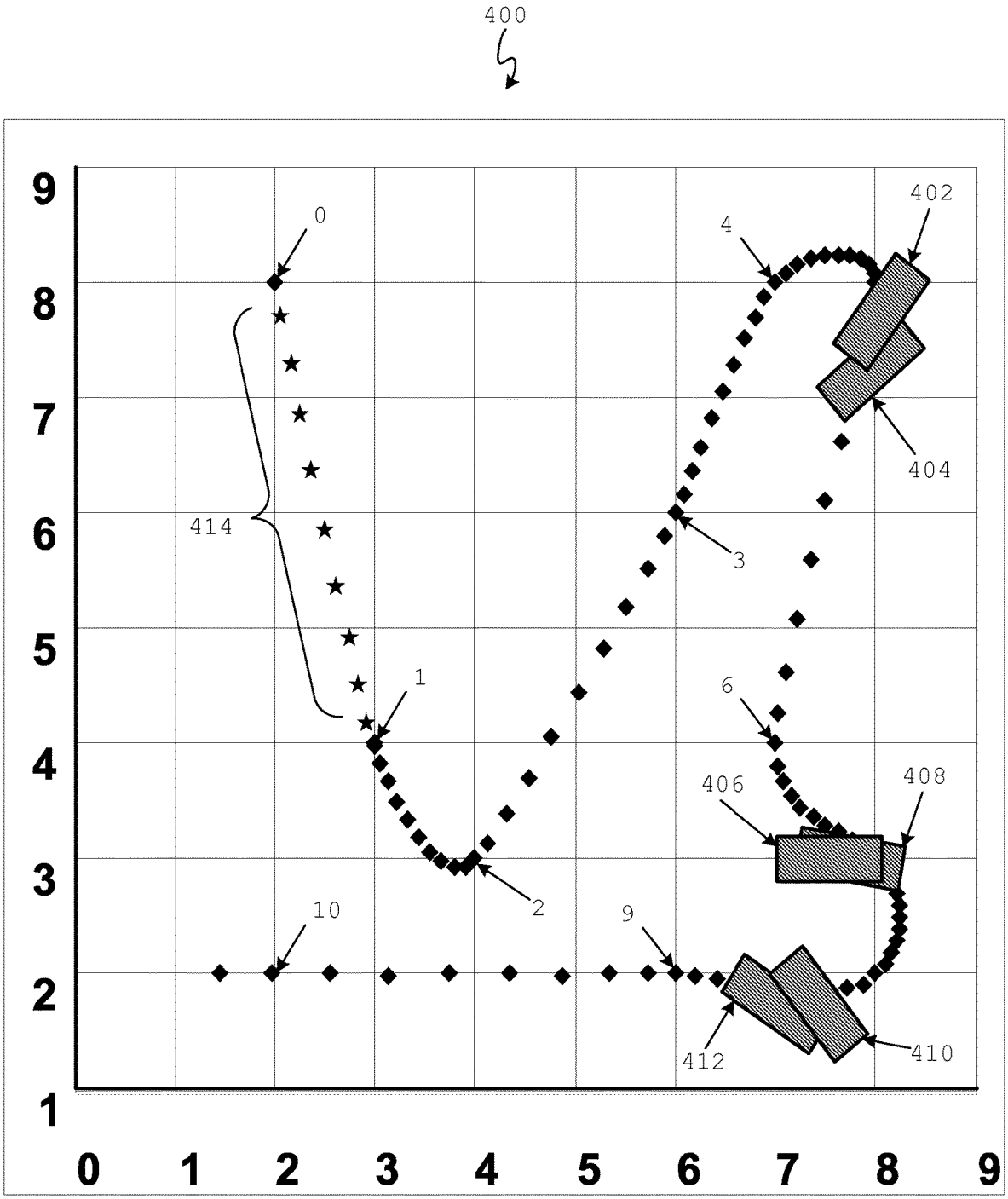
FIG. 4 illustrates an accident reconstruction comprising a trajectory of a vehicle involved in an accident and further identifying locations within the trajectory where the vehicle lost traction, in accordance with embodiments of the present invention.

FIG. 4 illustrates a Cartesian Coordinate Plane 400 comprising a trajectory of a vehicle involved in an accident and further identifying locations within the trajectory where the vehicle was speeding or lost traction, in accordance with embodiments of the present invention.

The Cartesian Coordinate Plane 400 comprises GNSS locations 0 through 10 for one of the vehicles involved in the accident. The Plane 400 further includes the intermediate GNSS locations between known GNSS locations 0 through 10 for the vehicle involved in the accident. 414 represents the marks made pursuant to step 118 (see FIG. 1, supra) that identify when the vehicle involved in the accident was speeding. The intermediate GNSS locations identified as stars 414 are different enough to signify to an end user that the vehicle's speed was exceeding the speed threshold between GNSS locations 0 and 1.

Additionally, the Plane 400 includes marks that convey to an end user the vehicle was skidding. These marks are represented by the rectangles 402 through 412. The marks 402 through 412 signify to an end user that the vehicle's orientation was exceeding the skid threshold throughout the trajectory from GNSS locations 4 through 9. The entire Cartesian Coordinate Plane 400 illustrated herein was produced pursuant to steps 102 through 120, see FIG. 1, supra.

FIG. 5 illustrates a computer system 900 which may facilitate a method for identifying a trajectory for each vehicle involved in an accident, in accordance with embodiments of the present invention.

The computer system 900 comprises a processor 908, an input device 906 coupled to the processor 908, an output device 910 coupled to the processor 908, and memory devices 902 and 912 each coupled to the processor 908.

The input device 906 may be, inter alia, a keyboard, a mouse, a keypad, a touchscreen, a voice recognition device, a sensor, a network interface card (NIC), a Voice/video over Internet Protocol (VoIP) adapter, a wireless adapter, a telephone adapter, a dedicated circuit adapter, etc.

The output device 910 may be, inter alia, a printer, a plotter, a computer screen, a magnetic tape, a removable hard disk, a floppy disk, a NIC, a VoIP adapter, a wireless adapter, a telephone adapter, a dedicated circuit adapter, an audio and/or visual signal generator, a light emitting diode (LED), etc.

The memory devices 902 and 912 may be, inter alia, a cache, a dynamic random access memory (DRAM), a read-only memory (ROM), a hard disk, a floppy disk, a magnetic tape, an optical storage such as a compact disc (CD) or a digital video disc (DVD), etc. The memory device 912 includes a computer code 914 which is a computer program that comprises computer-executable instructions.

The computer code 914 includes, inter alia, an algorithm used for identifying a trajectory for each vehicle involved in an accident according to the present invention. The processor 908 executes the computer code 914. The memory device 902 includes input data 904. The input data 904 includes input required by the computer code 914. The output device 910 displays output from the computer code 914. Either or both memory devices 902 and 912 (or one or more additional memory devices not shown in FIG. 5) may be used as a computer usable medium (or a computer readable medium or a program storage device) having a computer readable program embodied therein and/or having other data stored therein, wherein the computer readable program comprises the computer code 914. Generally, a computer program product (or, alternatively, an article of manufacture) of the computer system 900 may comprise said computer usable medium (or said program storage device).

Any of the components of the present invention can be deployed, managed, serviced, etc. by a service provider that offers to deploy or integrate computing infrastructure with respect to a process for identifying a trajectory for each vehicle involved in an accident. Thus, the present invention discloses a process for supporting computer infrastructure, comprising integrating, hosting, maintaining and deploying computer-readable code into a computing system (e.g., computing system 900), wherein the code in combination with the computing system is capable of performing a method for identifying a trajectory for each vehicle involved in an accident.

In another embodiment, the invention provides a business method that performs the process steps of the invention on a subscription, advertising and/or fee basis. That is, a service provider, such as a Solution Integrator, can offer to create, maintain, support, etc. a process for authenticating an end user. In this case, the service provider can create, maintain, support, etc. a computer infrastructure that performs the process steps of the invention for one or more customers. In return, the service provider can receive payment from the customer(s) under a subscription and/or fee agreement, and/or the service provider can receive payment from the sale of advertising content to one or more third parties.

While FIG. 5 shows the computer system 900 as a particular configuration of hardware and software, any configuration of hardware and software, as would be known to a person of ordinary skill in the art, may be utilized for the purposes stated supra in conjunction with the particular computer system 900 of FIG. 5. For example, the memory devices 902 and 912 may be portions of a single memory device rather than separate memory devices.

While particular embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed:

1. A method for reconstructing an accident for a vehicle involved in the accident, said method comprising:

receiving, by a processor of a computer system from an accident report pertaining to the accident, vehicle data pertaining to the vehicle over a period of time relevant to the accident, said period of time relevant to the accident encompassing I discrete times, wherein I is a positive integer of at least 2; wherein for i=1, 2, . . . , I: the vehicle data comprises $T_i$, $x_i$, $y_i$, $Dx_i$, and $Dy_i$, wherein $T_i$ denotes time i whose value is an integer, and wherein the vehicle is the only vehicle appearing in the accident report;

said processor identifying locations ($x_i$, $y_i$) determined by a Global Navigation Satellite System (GLASS), such that $x_i$ and $y_i$ denote a position of the vehicle along an x-axis and a y-axis of a cartesian coordinate system, respectively, at time $T_i$, wherein $Dx_i$, and $Dy_i$ are values along the x-axis and y-axis such that ($Dx_i$, $Dy_i$) identifies a direction in which the vehicle is pointing, and wherein $T_{i+1}-T_i \geq 2$ for i=1, 2, . . . , I−1;

for each time interval $(\Delta T)_i$ from time $T_i$ to time $T_{i+1}$ (i=1, 2, . . . , I−1), said processor computing and plotting a trajectory of the vehicle during the accident, said plotting the trajectory comprising plotting on a computer screen a position $(XX, YY)_j$ of the vehicle at each time j for $j=T_i+1, T_i+2, \ldots, T_{i+1}-1$ such that XX and YY denote a position of the vehicle along the x-axis and the y-axis, respectively, at time j, wherein the plotted graph on the computer screen is visible to a user viewing the computer screen, wherein said computing and plotting the position $(XX, YY)_j$ of the vehicle at time j utilizes the received vehicle data and identified locations as input and comprises:

determining an integer z that satisfies a condition of $T_z \leq j < T_{z+1}$, computing a parameter λ according to $\lambda=(j-T_z)/(T_{z+1}-T_z)$, computing XX at time j as a function of λ, $x_i$, $x_{i+1}$, $Dx_i$, and $Dx_{i+1}$, computing YY at time j as a function of λ, $y_i$, $y_{i+1}$, $Dy_i$, and $Dy_{i+1}$; and plotting XX and YY at time j as a spatial point on a graph in the cartesian coordinate system;

after said computing and plotting a position $(XX, YY)_j$ for all said times j for i=1, 2, . . . , I−1, said processor sending the graph of the plotted spatial points to an output device of the computer system;

determining, utilizing the plotted graph, whether the vehicle is speeding in each time interval $(\Delta T)_i$ (i=1, 2, . . . , I−1) by:

computing, utilizing the plotted graph, an average speed ($V_i$) of the vehicle for each time interval $(\Delta T)_i$ from time $T_i$ to time $T_{i+1}$ (i=1, 2, . . . , I−1) according to (Distance Traveled)/(Time of Travel) wherein Distance Traveled in time interval $(\Delta T)_i$ is a function of $x_i$, $y_i$, $x_{i+1}$, and $Y_{i+1}$, and wherein Time of Travel in time interval $(\Delta T)_i$ is a function of $T_i$ and $T_{i+1}$, determining, utilizing the plotted graph, whether the average speed $V_i$ of the vehicle for each time interval $(\Delta T)_i$ exceeds a specified speed threshold ($V_{th}$) equal to a speed limit for a road on which the accident occurred, determining that the vehicle is speeding in time interval $(\Delta T)_i$ (i=1, 2, . . . , I−1) in response to a determination that $V_i$ exceeds $V_{th}$, determining that the vehicle is not speeding in time interval $(\Delta T)_i$ (i=1, 2, . . . , I−1) in response to a determination that $V_i$ does not exceed $V_{th}$; and determining whether the vehicle is skidding at each time $T_i$ (i=1, 2, . . . , I−1) by:

determining, utilizing the plotted graph, whether the vehicles has an Orientation ($ORIENT_i$) at time $T_i$ that exceeds a specified skid threshold ($SKID_{th}$), said Orientation ($ORIENT_i$) at time $T_i$ being measured by ($Dx_i$, $Dy_i$), determining, utilizing the plotted graph, that the vehicle is skidding at time $T_i$ (i=1, 2, . . . , I−1) in response to a determination that $ORIENT_i$ exceeds $SKID_{th}$, determining; utilizing the plotted graph, that the vehicle is not skidding at time $T_i$ (i=1, 2, . . . , I−1) in response to a determination that $ORIENT_i$ does not exceed $SKID_{th}$;

reconstructing the accident for the vehicle, utilizing: said plotting the trajectory of the vehicle during the accident, said determining whether the vehicle is speeding in each time interval $(\Delta T)_i$ (i=1, 2, . . . , I−1), and said determining whether the vehicle is skidding at each time $T_i$ (i=1, 2, . . . , I−1);

making a determination, from the reconstructed accident, that the vehicle engaged in skidding, including uncontrollable sliding, during the accident.

2. The method of claim 1, wherein said computing XX at time j and said computing YY at time j comprises:

computing parameters $X_0$, $X_1$, $X_2$, $X_3$, $Y_0$, $Y_1$, $Y_2$, and $Y_3$ according to $$X_0=x_i,\ X_1=x_i+(Dx_i/3),\ X_2=x_{i+1}+(Dx_{i+1}/3),\ X_3=x_{i+1},$$

$$Y_0=y_i,\ Y_1=y_i+(Dy_i/3),\ Y_2=y_{i+1}+(Dy_{i+1}/3),\ Y_3=y_{i+1},$$

and computing XX and YY at time j according to $$XX=X_0*(1-\lambda)^3+3+X_1*\lambda*(1-\lambda)^2+3*X_2*\lambda^2*(1-\lambda)+X_3*\lambda^3$$

$$YY=Y_0*(1-\lambda)^3+3+Y_1*\lambda*(1-\lambda)^2+3*Y_2*\lambda^2*(1-\lambda)+Y_3*\lambda^3.$$

3. A computer program product, comprising a computer readable hardware storage device having computer readable program code stored therein, said program code configured to be executed by a processor of a computer system to implement a method for reconstructing an accident for a vehicle involved in the accident, said method comprising:

receiving, by said processor from an accident report pertaining to the accident, vehicle data pertaining to the vehicle over a period of time relevant to the accident, said period of time relevant to the accident encompassing I discrete times, wherein I is a positive integer of at least 2, wherein for i=1, 2, . . . , I: the vehicle data comprises $T_i$, $x_i$, $y_i$, $Dx_i$, and $Dy_i$, wherein $T_i$ denotes time i whose value is an integer, and wherein the vehicle is the only vehicle appearing in the accident report;

said processor identifying locations $(x_i, y_i)$ determined by a Global Navigation Satellite System (GLASS), such that $x_i$ and $y_i$ denote a position of the vehicle along an x-axis and a y-axis of a cartesian coordinate system, respectively, at time wherein $Dx_i$, and $Dy_i$ are values along the x-axis and y-axis such that $(Dx_i, Dy_i)$ identifies a direction in which the vehicle is pointing, and wherein $T_{i+1}-T_i \geq 2$ for i=1, 2, . . . , I−1;

for each time interval $(\Delta T)_i$ from time $T_i$ to time $T_{i+1}$ (i=1, 2, . . . , I−1), said processor computing and plotting a trajectory of the vehicle during the accident, said plotting the trajectory comprising plotting on a computer screen a position $(XX, YY)_j$ of the vehicle at each time j for $j=T_i+1, T_i+2, \ldots, T_{i+1}-1$ such that XX and YY denote a position of the vehicle along the x-axis and the y-axis, respectively, at time j, wherein the plotted graph on the computer screen is visible to a user viewing the computer screen, wherein said computing and plotting the position $(XX, YY)_j$ of the vehicle at time j utilizes the received vehicle data and identified locations as input and comprises:

determining an integer z that satisfies a condition of $T_z \leq j < T_{z+1}$, computing a parameter λ according to $\lambda=(j-T_z)/(T_{z+1}-T_z)$, computing XX at time j as a function of λ, $x_i$, $x_{i+1}$, $Dx_i$, and $Dx_{i+1}$, computing YY at time j as a function of λ, $y_i$, $y_{i+1}$, $Dy_i$, and $Dy_{i+1}$; and plotting XX and YY at time j as a spatial point on a graph in the cartesian coordinate system;

after said computing and plotting a position $(XX, YY)_j$ for all said times j for i=1, 2, . . . , I−1, said processor sending the graph of the plotted spatial points to an output device of the computer system;

determining, utilizing the plotted graph, whether the vehicle is speeding in each time interval $(\Delta T)_i$ (i=1, 2, . . . , I−1) by:

computing, utilizing the plotted graph, an average speed $(V_i)$ of the vehicle for each time interval $(\Delta T)_i$ from time $T_i$ to time $T_{i+1}$ (i=1, 2, . . . , I−1) according to (Distance Traveled)/(Time of Travel) wherein Distance Traveled in time interval $(\Delta T)_i$ is a function of $x_i$, $y_i$, $x_{i+1}$, and $Y_{i+1}$, and wherein Time of Travel in time interval $(\Delta T)_i$ is a function of $T_i$ and $T_{i+1}$, determining, utilizing the plotted graph, whether the average speed $V_i$ of the vehicle for each time interval $(\Delta T)_i$ exceeds a specified speed threshold $(V_{th})$ equal to a speed limit for a road on which the accident occurred, determining that the vehicle is speeding in time interval $(\Delta T)_i$ (i=1, 2, . . . , I−1) in response to a determination that $V_i$ exceeds $V_{th}$, determining that the vehicle is not speeding in time interval $(\Delta T)_i$ (i=1, 2, . . . , I−1) in response to a determination that $V_i$ does not exceed $V_{th}$; and determining whether the vehicle is skidding at each time $T_i$ (i=1, 2, . . . , I−1) by:

determining, utilizing the plotted graph, whether the vehicles has an Orientation $(ORIENT_i)$ at time $T_i$ that exceeds a specified skid threshold $(SKID_{th})$, said Orientation $(ORIENT_i)$ at time $T_i$ being measured by $(Dx_i, Dy_i)$, determining, utilizing the plotted graph, that the vehicle is skidding at time $T_i$ (i=1, 2, . . . , I−1) in response to a determination that $ORIENT_i$ exceeds $SKID_{th}$, determining; utilizing the plotted graph, that the vehicle is not skidding at time $T_i$ (i=1, 2, . . . , I−1) in response to a determination that $ORIENT_i$ does not exceed $SKID_{th}$;

reconstructing the accident for the vehicle, utilizing: said plotting the trajectory of the vehicle during the accident, said determining whether the vehicle is speeding in each time interval $(\Delta T)_i$ (i=1, 2, . . . , I−1), and said determining whether the vehicle is skidding at each time $T_i$ (i=1, 2, . . . , I−1);

making a determination, from the reconstructed accident, that the vehicle engaged in skidding, including uncontrollable sliding, during the accident.

4. The computer program product of claim 3, wherein said computing XX at time j and said computing YY at time j comprises:

computing parameters $X_0$, $X_1$, $X_2$, $X_3$, $Y_0$, $Y_1$, $Y_2$, and $Y_3$ according to $$X_0=x_i,\ X_1=x_i+(Dx_i/3),\ X_2=x_{i+1}+(Dx_{i+1}/3),\ X_3=x_{i+1},$$

$$Y_0=y_i,\ Y_1=y_i+(Dy_i/3),\ Y_2=y_{i+1}+(Dy_{i+1}/3),\ Y_3=y_{i+1},$$

and computing XX and YY at time j according to $$XX=X_0*(1-\lambda)^3+3+X_1*\lambda*(1-\lambda)^2+3*X_2*\lambda^2*(1-\lambda)+X_3*\lambda^3$$

$$YY=Y_0*(1-\lambda)^3+3+Y_1*\lambda*(1-\lambda)^2+3*Y_2*\lambda^2*(1-\lambda)+Y_3*\lambda^3.$$

5. A computer system comprising a processor, a memory coupled to the processor, and a computer readable storage device coupled to the processor, said storage device containing program code configured to be executed by the processor via the memory to implement a method for reconstructing an accident for a vehicle involved in the accident, said method comprising:

receiving, by said processor from an accident report pertaining to the accident, vehicle data pertaining to the vehicle over a period of time relevant to the accident, said period of time relevant to the accident encompassing I discrete times, wherein I is a positive integer of at least 2, wherein for i=1, 2, . . . , I: the vehicle data comprises $T_i$, $x_i$, $y_i$, $Dx_i$, and $Dy_i$, wherein $T_i$ denotes time i whose value is an integer, and wherein the vehicle is the only vehicle appearing in the accident report;

said processor identifying locations ($x_i$, $y_i$) determined by a Global Navigation Satellite System (GLASS), such that $x_i$ and $y_i$ denote a position of the vehicle along an x-axis and a y-axis of a cartesian coordinate system, respectively, at time $T_i$, wherein $Dx_i$, and $Dy_i$ are values along the x-axis and y-axis such that ($Dx_i$, $Dy_i$) identifies a direction in which the vehicle is pointing, and wherein $T_{i+1}-T_i \geq 2$ for i=1, 2, . . . , I−1;

for each time interval $(\Delta T)_i$ from time $T_i$ to time $T_{i+1}$ (i=1, 2, . . . , I−1), said processor computing and plotting a trajectory of the vehicle during the accident, said plotting the trajectory comprising plotting on a computer screen a position $(XX, YY)_j$ of the vehicle at each time j for $j=T_i+1, T_i+2, \ldots, T_{i+1}-1$ such that XX and YY denote a position of the vehicle along the x-axis and the y-axis, respectively, at time j, wherein the plotted graph on the computer screen is visible to a user viewing the computer screen, wherein said computing and plotting the position $(XX, YY)_j$ of the vehicle at time j utilizes the received vehicle data and identified locations as input and comprises:

determining an integer z that satisfies a condition of $T_z \leq j < T_{z+1}$, computing a parameter λ according to $\lambda=(j-T_z)/(T_{z+1}-T_z)$, computing XX at time j as a function of λ, $x_i$, $x_{i+1}$, $Dx_i$, and $Dx_{i+1}$, computing YY at time j as a function of λ, $y_i$, $y_{i+1}$, $Dy_i$, and $Dy_{i+1}$; and plotting XX and YY at time j as a spatial point on a graph in the cartesian coordinate system;

after said computing and plotting a position $(XX, YY)_j$ for all said times j for i=1, 2, . . . , I−1, said processor sending the graph of the plotted spatial points to an output device of the computer system;

determining, utilizing the plotted graph, whether the vehicle is speeding in each time interval $(\Delta T)_i$ (i=1, 2, . . . , I−1) by:

computing, utilizing the plotted graph, an average speed ($V_i$) of the vehicle for each time interval $(\Delta T)_i$ from time $T_i$ to time $T_{i+1}$ (i=1, 2, . . . , I−1) according to (Distance Traveled)/(Time of Travel) wherein Distance Traveled in time interval $(\Delta T)_i$ is a function of $x_i$, $y_i$, $x_{i+1}$, and $Y_{i+1}$, and wherein Time of Travel in time interval $(\Delta T)_i$ is a function of $T_i$ and $T_{i+1}$, determining, utilizing the plotted graph, whether the average speed $V_i$ of the vehicle for each time interval $(\Delta T)_i$ exceeds a specified speed threshold ($V_{th}$) equal to a speed limit for a road on which the accident occurred, determining that the vehicle is speeding in time interval $(\Delta T)_i$ (i=1, 2, . . . , I−1) in response to a determination that $V_i$ exceeds $V_{th}$, determining that the vehicle is not speeding in time interval $(\Delta T)_i$ (i=1, 2, . . . , I−1) in response to a determination that $V_i$ does not exceed $V_{th}$; and determining whether the vehicle is skidding at each time $T_i$ (i=1, 2, . . . , I−1) by:

determining, utilizing the plotted graph, whether the vehicles has an Orientation ($ORIENT_i$) at time $T_i$ that exceeds a specified skid threshold ($SKID_{th}$), said Orientation ($ORIENT_i$) at time $T_i$ being measured by ($Dx_i$, $Dy_i$), determining, utilizing the plotted graph, that the vehicle is skidding at time $T_i$ (i=1, 2, . . . , I−1) in response to a determination that $ORIENT_i$ exceeds $SKID_{th}$, determining; utilizing the plotted graph, that the vehicle is not skidding at time $T_i$ (i=1, 2, . . . , I−1) in response to a determination that $ORIENT_i$ does not exceed $SKID_{th}$;

reconstructing the accident for the vehicle, utilizing: said plotting the trajectory of the vehicle during the accident, said determining whether the vehicle is speeding in each time interval $(\Delta T)_i$ (i=1, 2, . . . , I−1), and said determining whether the vehicle is skidding at each time $T_i$ (i=1, 2, . . . , I−1);

making a determination, from the reconstructed accident, that the vehicle engaged in skidding, including uncontrollable sliding, during the accident.

6. The computer system of claim 5, wherein said computing XX at time j and said computing YY at time j comprises:

computing parameters $X_0$, $X_1$, $X_2$, $X_3$, $Y_0$, $Y_1$, $Y_2$, and $Y_3$ according to $$X_0=x_i,\ X_1=x_i+(Dx_i/3),\ X_2=x_{i+1}+(Dx_{i+1}/3),\ X_3=x_{i+1},$$

$$Y_0=y_i,\ Y_1=y_i+(Dy_i/3),\ Y_2=y_{i+1}+(Dy_{i+1}/3),\ Y_3=y_{i+1},$$

and computing XX and YY at time j according to $$XX=X_0*(1-\lambda)^3+3+X_1*\lambda*(1-\lambda)^2+3*X_2*\lambda^2*(1-\lambda)+X_3*\lambda^3$$

$$YY=Y_0*(1-\lambda)^3+3+Y_1*\lambda*(1-\lambda)^2+3*Y_2*\lambda^2*(1-\lambda)+Y_3*\lambda^3.$$

* * * * *